US005577830A

United States Patent [19]

Barry et al.

[11] Patent Number: 5,577,830

[45] Date of Patent: Nov. 26, 1996

[54] ILLUMINATED AWNING

[75] Inventors: Martin Barry, Dublin; David McKeown, Celbridge, both of Ireland

[73] Assignee: Illuminated Awning Systems Limited, Dublin, Ireland

[21] Appl. No.: 335,853

[22] PCT Filed: May 18, 1993

[86] PCT No.: PCT/IE93/00028

§ 371 Date: Nov. 9, 1994

§ 102(e) Date: Nov. 9, 1994

[87] PCT Pub. No.: WO93/23634

PCT Pub. Date: Nov. 25, 1993

[30] Foreign Application Priority Data

May 18, 1992 [IE] Ireland ..... 1582/92

[51] Int. Cl.[6] ..... F21S 3/02

[52] U.S. Cl. ..... 362/152; 362/224; 362/278; 362/320; 362/361; 362/812; 40/603; 52/28; 52/74; 160/76

[58] Field of Search ..... 40/564, 603, 604; 362/152, 278, 320, 352, 361, 450, 812, 223, 224, 225, 367, 360; 52/28, 74; 160/56, 57, 76, 83.1, 328

[56] References Cited

U.S. PATENT DOCUMENTS

| | | | |
|---|---|---|---|
| Re. 33,709 | 10/1991 | Vicino | 40/603 |
| 2,562,553 | 7/1951 | Howenstine | 362/812 |
| 4,185,408 | 1/1980 | Tracy | 40/603 |
| 4,430,819 | 2/1984 | Chandler | 40/603 |
| 4,692,847 | 9/1987 | Gandy | 362/152 |
| 5,099,590 | 3/1992 | Yamaguchi | 40/603 |

*Primary Examiner*—Denise Gromada
*Assistant Examiner*—Alan B. Cariaso
*Attorney, Agent, or Firm*—Jacobson, Price, Holman & Stern, PLLC

[57] ABSTRACT

An awning comprises an outer sheet of flexible material supported on a rigid translucent support. The awning is illuminated by strip lights mounted on a support framework, which is stepped back from the rigid translucent support. An even illumination is achieved with no shadow lines on the flexible sheet. The sheet may have advertising indicia or logos.

13 Claims, 10 Drawing Sheets

ILLUMINATED AWNING

The invention relates to canopies and in particular to an awning for positioning above retail and/or service locations such as shop fronts, automated bank teller machines and the like.

Various awnings of this type are known, however, they are costly to install and maintain and in general are not particularly effective as advertising locations and in assisting and protecting customers. In particular the illumination of conventional awnings is generally uneven.

This invention is directed towards providing an awning which will overcome at least some of these problems and in particular to providing an awing in which the illumination is substantially even.

According to the invention there is provided an awning comprising:

a sheet material;

a support means for the sheet material; and illumination means for illuminating the sheet material, wherein the support means is translucent.

In one embodiment of the invention the illumination means is spaced rearwardly from the sheet material. Preferably the translucent support means comprises a substantially rigid support sheet of translucent material. The translucent support preferably conforms to at least portion of the desired shape of the sheet material. Typically the translucent support sheet is of at least partially arcuate shape.

In one embodiment of the invention the sheet support means is mounted to a framework. Preferably the framework comprises a lower support member and an upper support member to which the sheet support means is mounted.

In a particularly preferred arrangement the illumination means is mounted to the framework. Preferably the framework includes illuminating support means extending between upper and lower support members. Typically the illuminating support means comprises at least two spaced-apart illuminating means support members which are stepped back from the sheet support means. In a preferred arrangement each illumination means support member extends from an upper support member to a lower support member.

Preferably the upper support member is a rearward support member and the lower support member is a forward support member.

In one arrangement the illuminating means is (are) supported on mounting clips provided on the illuminating means support members.

Preferably the illuminating means comprises strip lights.

Typically the awning includes a pair of side panels. Preferably the awning also includes a bottom panel.

In one arrangement the framework is arranged to receive a security shutter housing.

Preferably the sheet material is of flexible material. Most preferably the flexible sheet material is mounted to facilitate tensioning of the sheet.

In a preferred embodiment of the invention the sheet material has an advertising indicia and/or logo marked thereon.

The invention will be more clearly understood from the following description thereof given by way of example only with reference to the accompanying drawings, in which.

Figure 1:
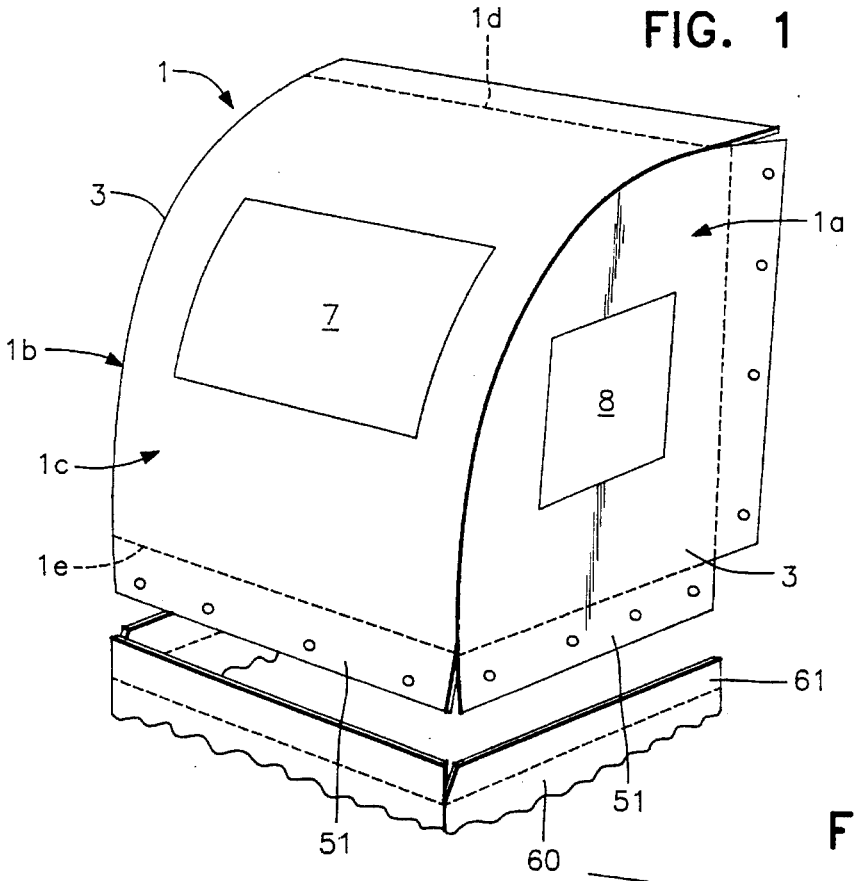
FIG. 1 is a perspective view of an awning according to the invention.
Figure 2:
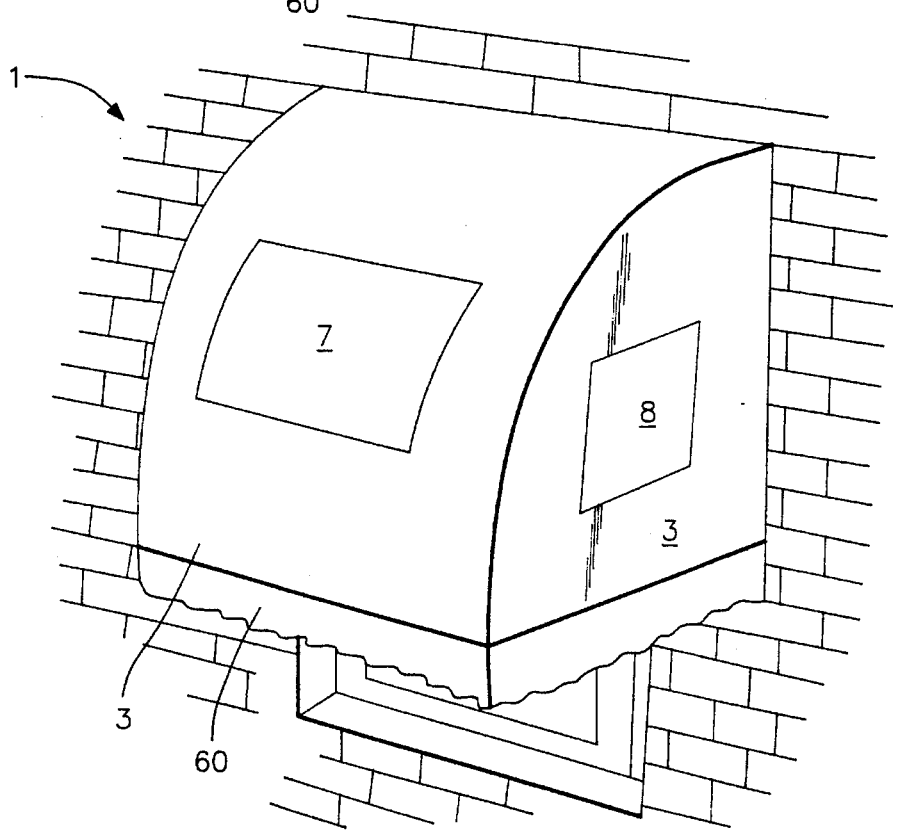
FIG. 2 is a perspective view of the awning in use.

Referring to the drawings and initially to FIGS. 1 to 8 thereof there is illustrated an awning according to the invention indicated generally by the reference numeral 1. The awning is shaped to provide opposite side portions 1*a*, 1*b* and a continuous main convex portion 1*c* defining a top and front awning surface with a top back edge 1*d* and a front bottom edge 1*e*. The edges are spaced apart in both vertical and horizontal planes. The awning 1 comprises translucent sheet supporting means 17 and a main support framework 2 for the translucent sheet supporting means which is stepped back from the translucent sheet supporting means and defines therebetween an area 10 through which light is transmitted from strip lights 5 through the flexible sheet material 3. The strip lights 5 are mounted by brackets 6 to the support framework 2. The translucent flexible sheet material 3 has indicia or logos such as advertising indicia or logos thereon for example, applied by printing or the like to front and/or side areas 7, 8 respectively. The areas 7, 8 may be of any desired size, shape and/or configuration.

In more detail, the framework 2 comprises a front lower support member 15, a rear upper support member 16, both of which, in this case, are of round bar construction so that the flexible sheet material 3 may be led over them without damaging the sheet material. The translucent sheet supporting means comprises a sheet 17 of rigid translucent material such as perspex material which is attached to support bars 18, 19 of the main support framework. In this case the rigid sheet 17 is of generally convex shape to conform with the desired shape of the flexible sheet material 3.

Figure 5:
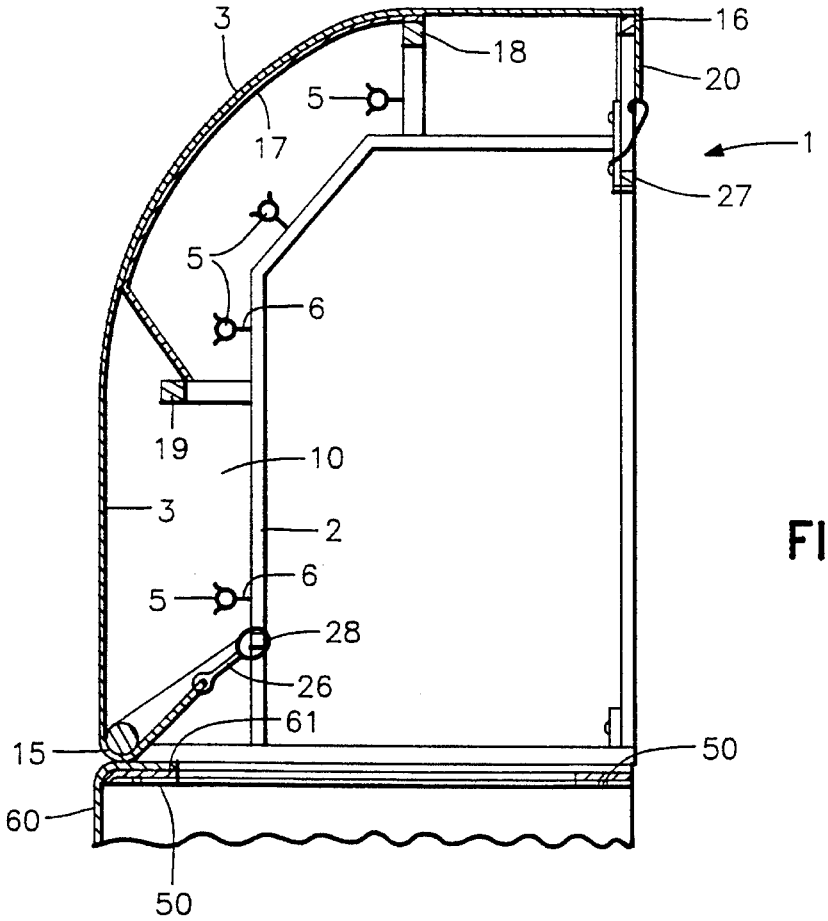
FIG. 5 is a transverse cross-sectional view of the awning.
Figure 4:
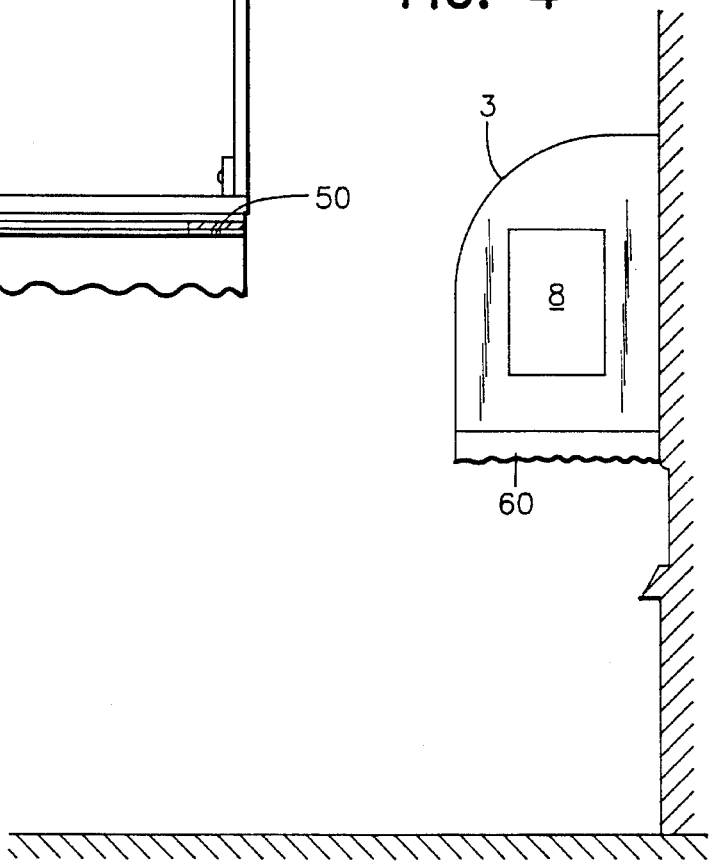
FIG. 4 is a side view of the awning in use.
Figure 8:
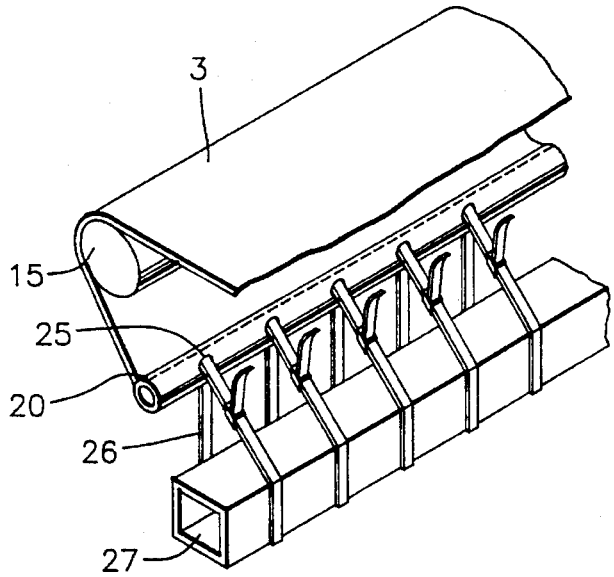
FIG. 8 is a perspective view of part of the awning.
Figure 9:
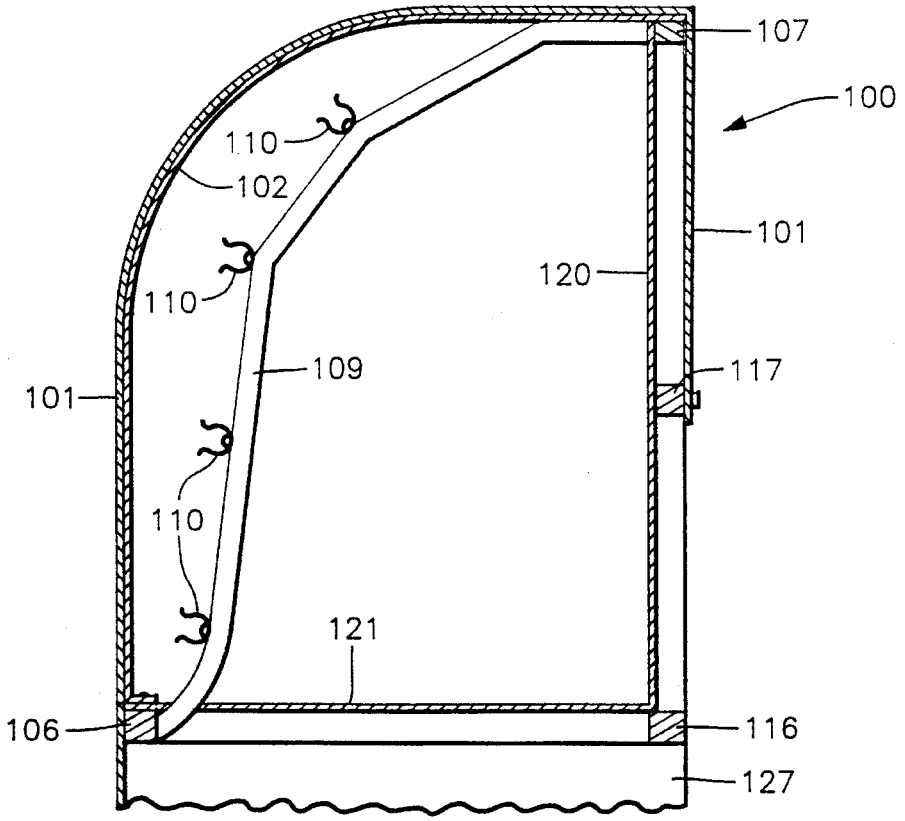
FIG. 9 is a side cross-sectional view of another awning according to the invention.
Figure 10:
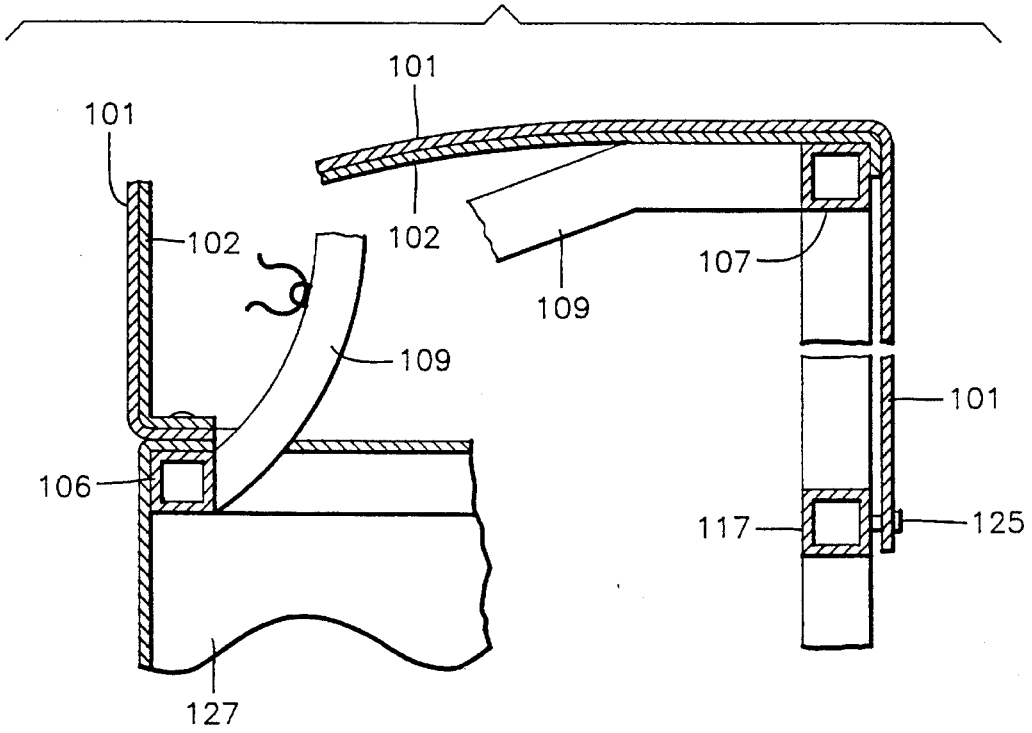
FIG. 10 is a cross sectional view of an enlarged scale of parts of the awning of FIG. 9.

As will be particularly apparent from FIGS. 5 and 8, in this case the ends 20, 21 of the flexible sheet material 3 have eyelets 25 through which tie wraps 26 are inserted and looped around respective upper and lower frame members 27, 28 of the main support framework. The sheet material 3 is tensioned by tightening the tie wraps 26 which draws the sheet material tautly over the arcuate support 17 and the front lower support member 15 and rear upper support member 16. Because of this arrangement the flexible sheet material 3 is taut over its full visible length so that no unsightly shadow lines are visible in use.

Figure 3:
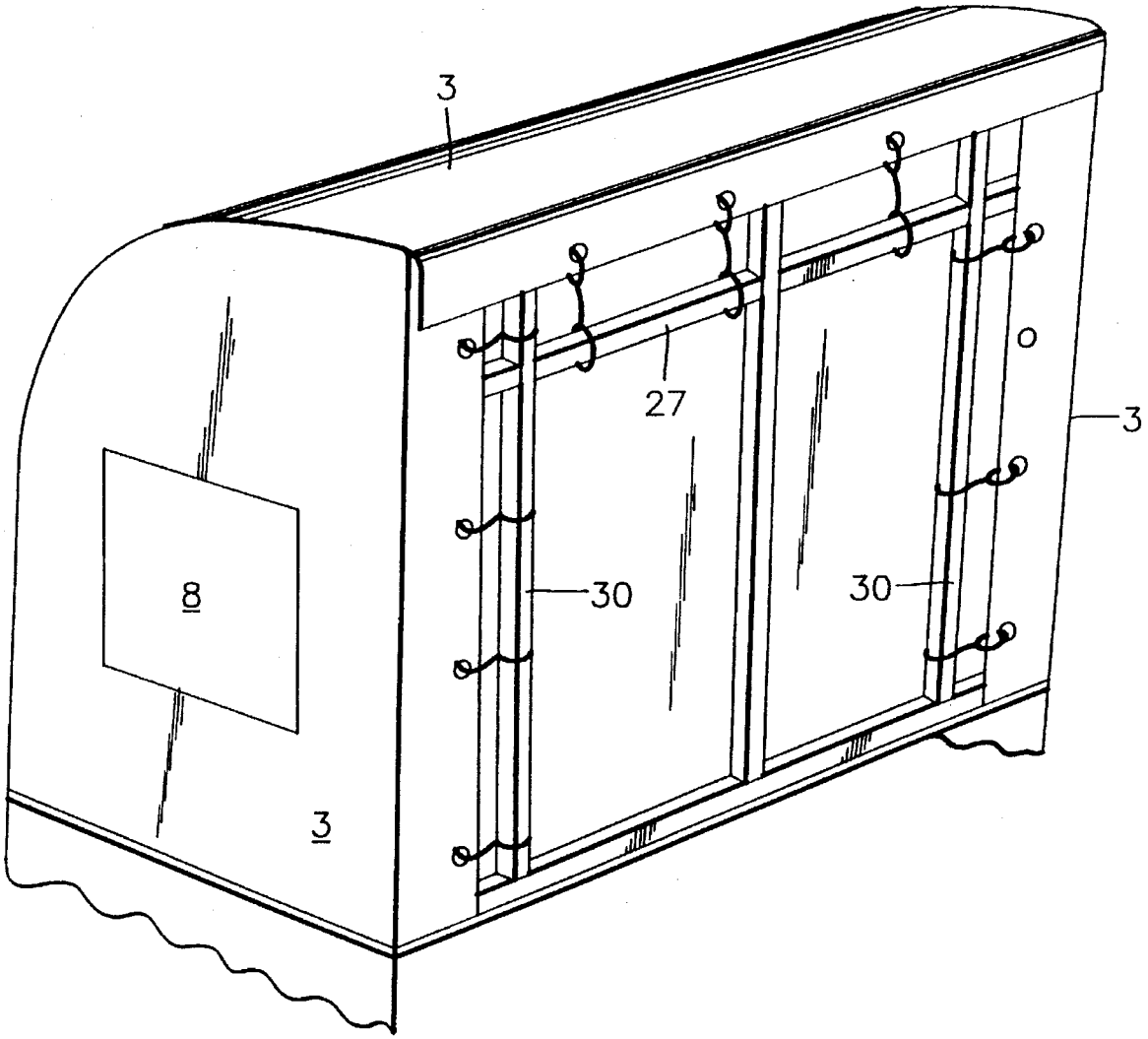
FIG. 3 is a perspective view from the rear of the awning.

The flexible sheet material 3 in this case also includes side panels which are attached to vertical frame members 30 of the main support framework as will be particularly apparent from FIG. 3.

Figure 6:
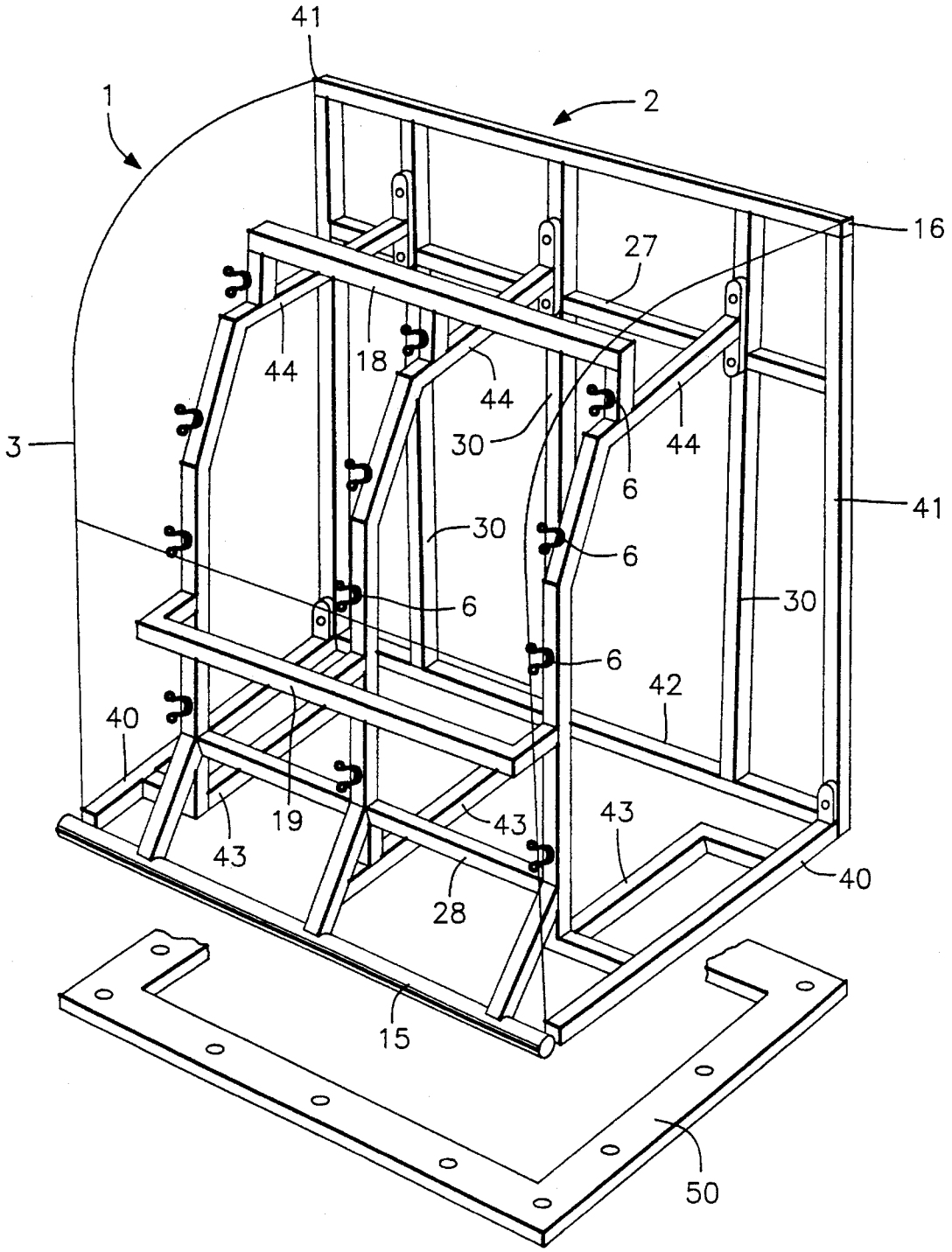
FIG. 6 is a perspective view of a framework forming part of the awning.
Figure 7:
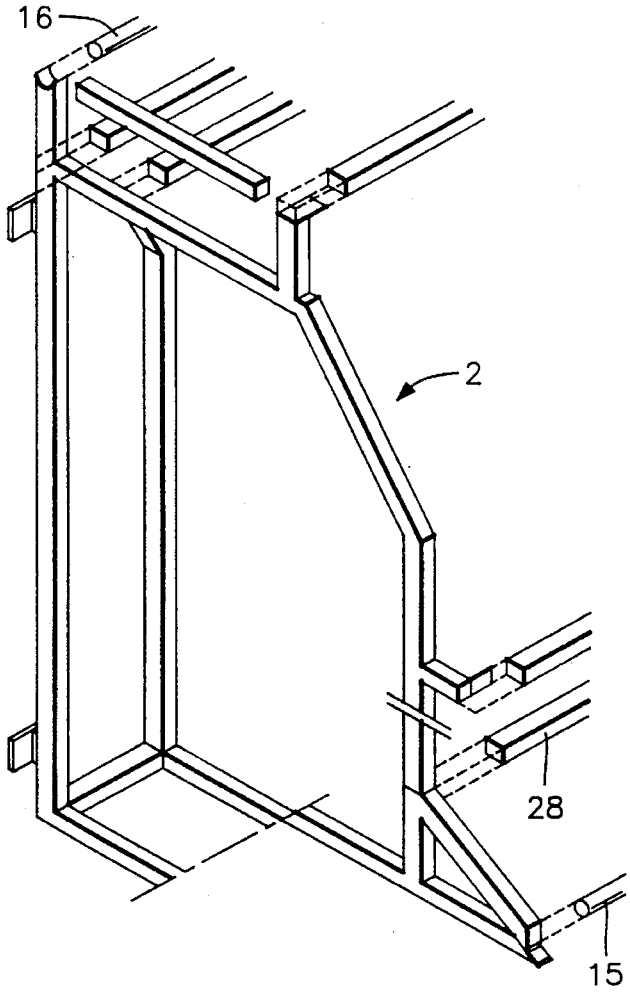
FIG. 7 is a perspective, partially exploded, view of part of the framework.

In addition to the frame members 18, 19, 27, 28 and 30 already referred to, the main support framework 2 also includes horizontal and vertical side frame members 40, 41 respectively, a lower rear horizontal main frame member 42, base frame members 43 and three intermediate frame members 44 extending as illustrated in FIG. 6 between the rear frame members 30 and base frame members 43.

A rim 50 is bolted to the base framework to retain lower flaps 51 of the flexible sheet material 3.

The awning may include a bib section 60 having a flap 61 which is folded inwardly as illustrated in FIG. 1 and may be retained in position by the rim 50.

The awning may be of any suitable materials of construction.

The sheet material supporting member 17 may be of polyethylene terephalate, polycarbonate, acrylic or polyvinylchloride material. The sheet may be curved over a radius section. It may be hot-line bent and fixed by means of rivets to the support framework. Alternatively the sheet may be vaccum formed. The translucent sheet may be cold curved around the two gable sections imparting rigidity to the resulting form. Alternatively the front face may be heat formed to a self supporting structure prior to application of the gable sections. The face and gables may alternatively be heat formed to the required shape, generally by pressure or vacuum means to provide self supporting strength and shape to the face and the gables. Particularly in the case of the supporting sheet being self supporting, for example if formed by vacuum or heat forming at least part of the support framework may be omitted. In particular, the curved set-back support members. In this case the lighting may be of the forward projecting type which may be mounted adjacent to the back shining forwardly and sidewardly to illuminate the front and gables which carry the decorated format.

The flexible sheet material may be of woven polyethylene/nylon reinforced vinyl/PVC and may be opal white or light transmitting colour with light transmission properties exceeding opaque.

The radius and/or the straight section of the sheet material may contain advertising logos or indicia which may be formed by coloured ink on the sheet leaving an opal white coloured message area. Alternatively the sheet material may be of standard opal form having a logo or indicia on a translucent coloured ink which may be screen printed or adhesively bonded. Many different decoration techniques may be applied to the flexible sheet material. Ink may be applied to a substrate which is in turn adhered to the front or rear face(s) of the sheet. The substrate may be a self adhesive substrate. The bib section of the awning may also carry logos or indicia such as a proprietor's details.

It will be appreciated that portion, for example a top rear portion of the sheet material, may be rendered opal or light transmitting to illuminate a building, advertising sign or the like.

It will be appreciated that any suitable tensioning system may be applied to tension the flexible sheet material in use.

Typically the framework is of fabricated stainless steel welded construction in which all welds are ground to prevent damage to the tensioned sheet material.

At least part of the frame may be of extruded aluminium, mild steel—powder coated or plain finish, galvanised—plastic coated or enamelled or of moulded structure plastic such as polyethylene, polypropylene, polyurethane or alloy of any of these materials.

The back section of the awning is preferably a white faced aluminium sheet secured by means of rivets to the framework. The downlit area of the awning is covered by a sheet of light diffusing material such as high carbonate material or the like and may be rivetted to the framework.

Referring now to FIGS. 9 to 13 there is illustrated another awning according to the invention indicated generally by the reference numeral 100. The awning 100 is similar to the illuminated awning described above with reference to FIGS. 1 to 8 except that in this case the construction is substantially simpler.

The awning 100 comprises a flexible sheet material 101 which typically bears advertising indicia or logos and a support means in the form of a substantially rigid support sheet 102 of translucent material around which the flexible sheet 101 is led and tensioned.

Figure 11:
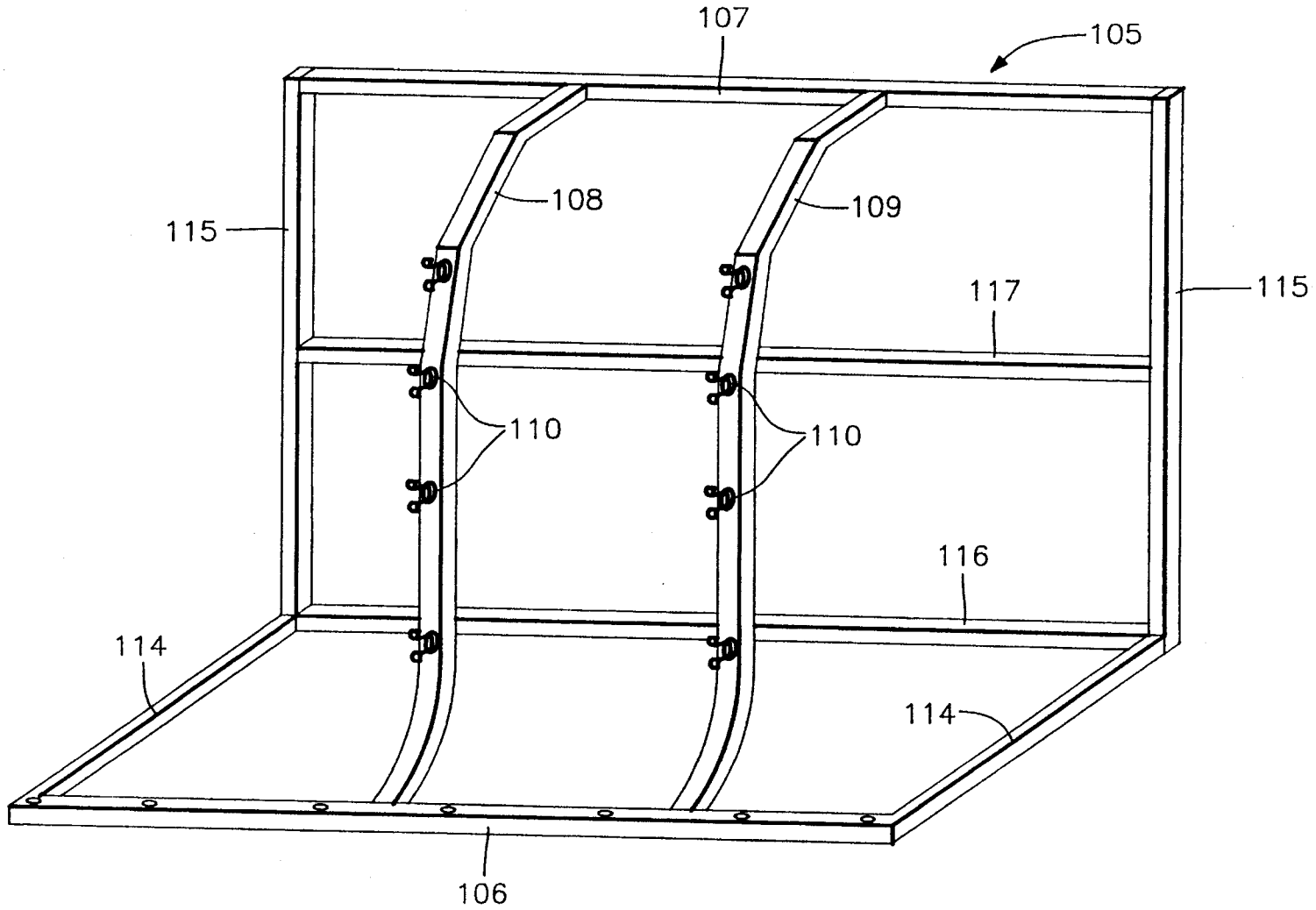
FIG. 11 is a perspective view from the front of a support framework forming part of the awning of FIG. 9.

The awning 100 also includes a support framework 105 which is shown in detail in FIG. 11 and comprises a front forward support member 106 an upper rear support member 107 to both of which the rigid support sheet 102 is mounted. The support framework also comprises two illuminating support members 108, 109 which are spaced-apart and are stepped back from the support sheet 102 in use as will be particularly apparent from FIG. 9. Each illuminating means support member 108, 109 carries four spaced-apart mounting clips 110 to which strip lights (not shown) are mounted. The framework in this case also includes horizontal and vertical side support members 114, 115, an additional longitudinal support members 116, 117 extending between the vertical side supports 115. Typically the framework 105 is fabricated from extruded aluminium sections.

Figure 12:
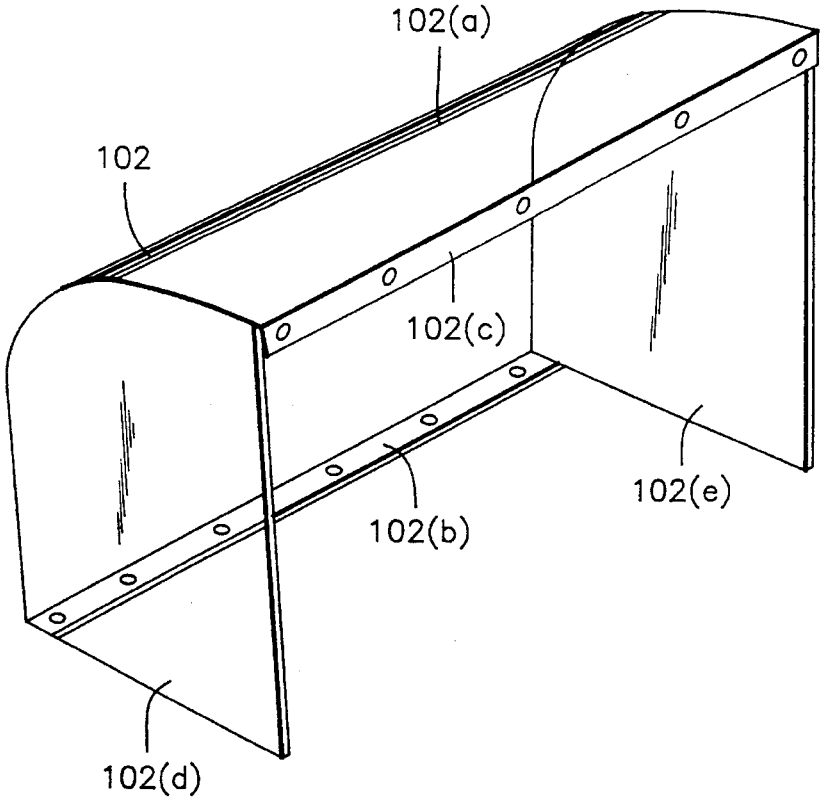
FIG. 12 is a perspective view from the rear of a translucent support forming part of the awning of FIG. 9.
Figure 13:
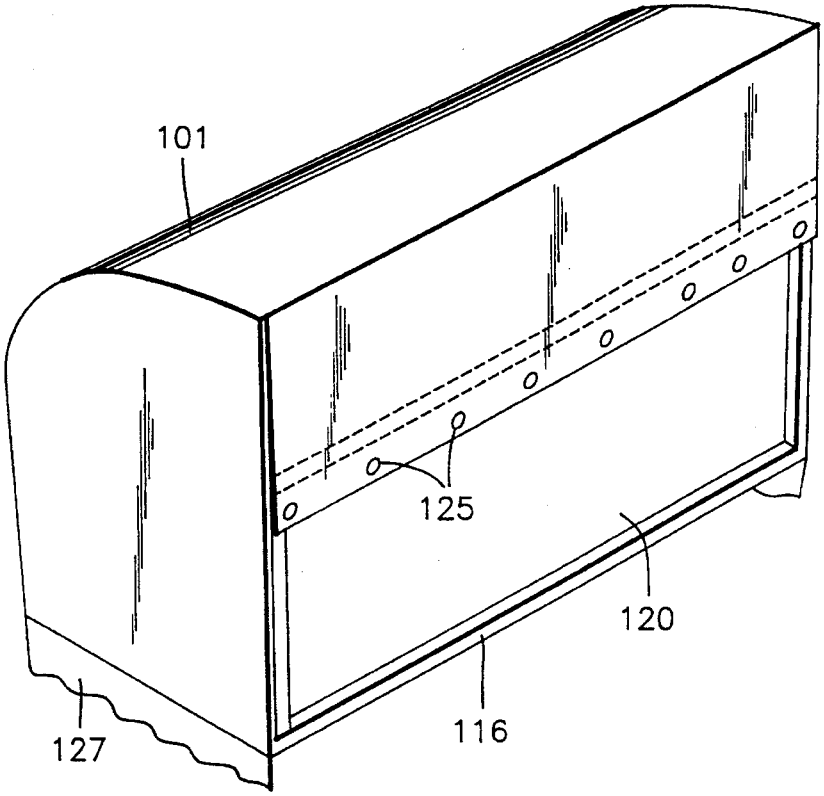
FIG. 13 is a perspective view from the rear of the awning.

Referring particularly to FIG. 12 the translucent rigid sheet material 102 comprises a main generally convex portion 102*a* having an inturned forward lip portion 102*b*, a down-turned rearward lip portion 102*c* and a pair of side panel sections 102*d*, 102*e*. The lip portions 102*b*, 102*c* are riveted to the front lower support member 106 of the support framework and the upper rearward support member 107 of the support framework respectively. A rear panel 120 and a bottom panel 121 are also provided. One or more of the panels may be removable for access.

As described in more detail above, the flexible sheet material bearing the advertising indicia or logo 101 is wrapped around the rigid support sheet 102 and secured in position by fixing to the front support member 106 of the framework 100 and hooking eyelets of the flexible sheet 101 over hooks 125 provided on the rear of the support member 117 of the framework 105. The flexible sheet 101 may also be provided with the bib portion 127.

Figure 14:
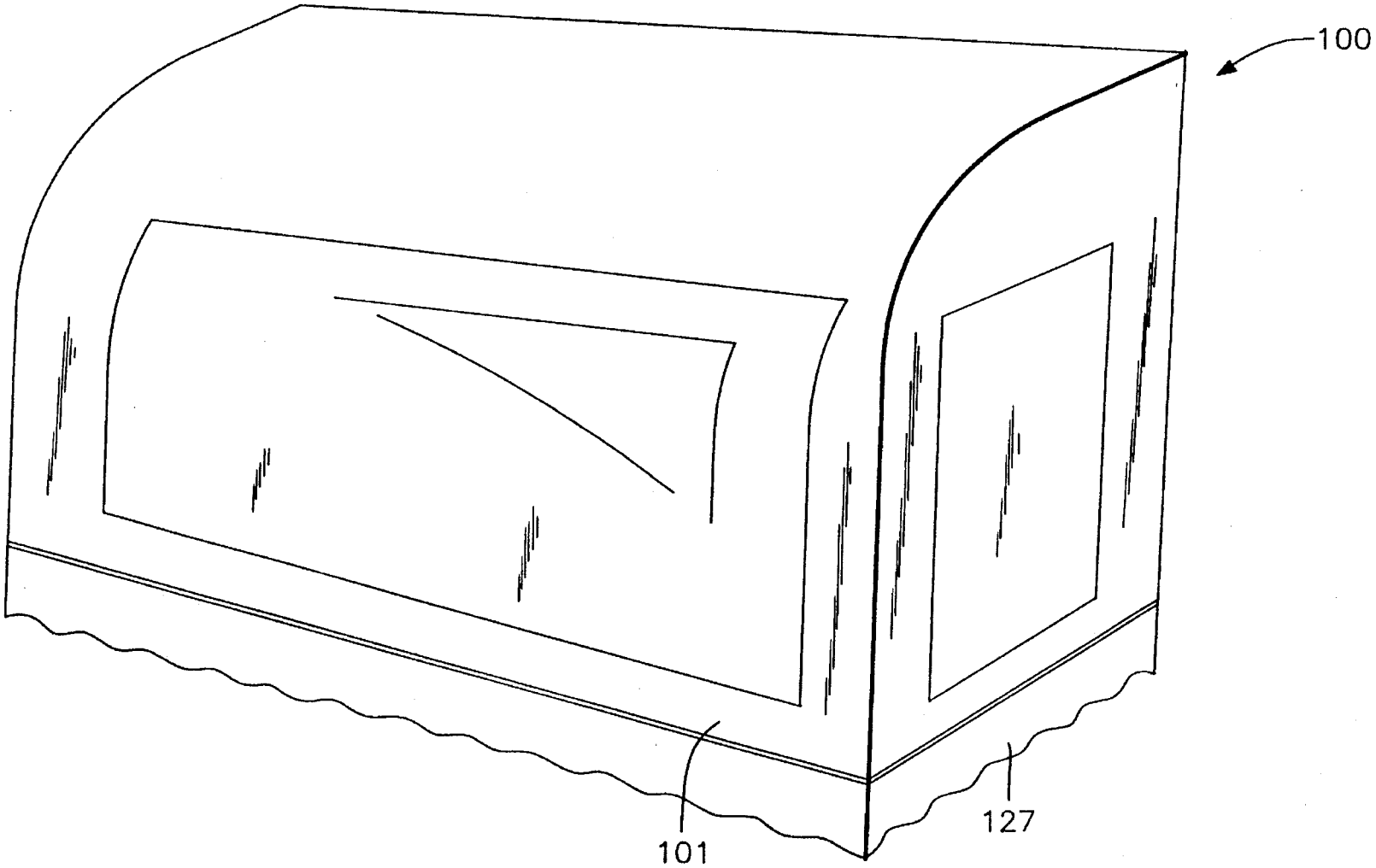
FIG. 14 is a perspective view of the awning.
Figure 15:
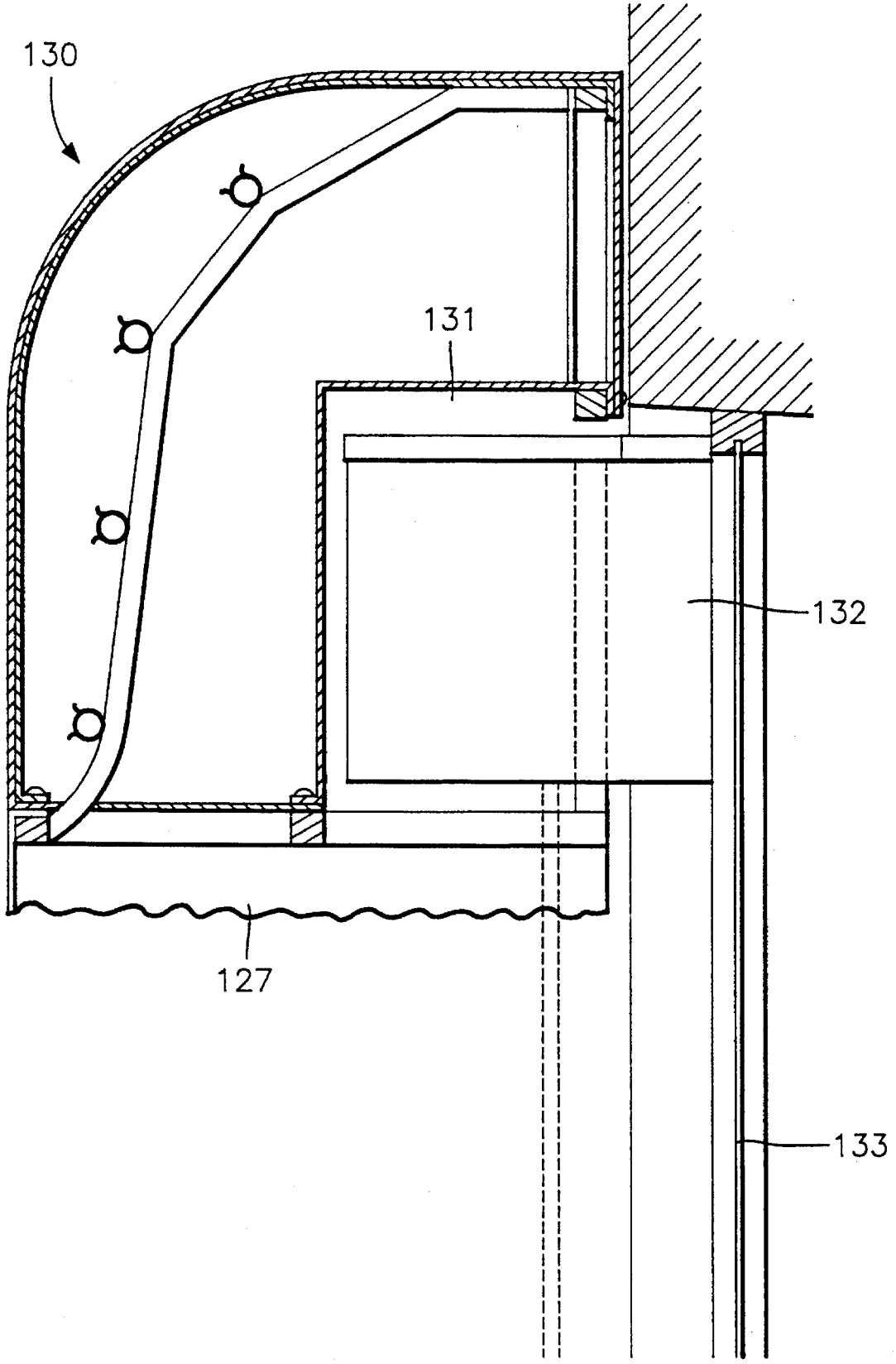
FIG. 15 is a side cross sectional view of a further awning according to the invention.

Referring to FIG. 14 there is illustrated another awning 130 according to the invention, which is similar to the awning described above with reference to FIGS. 9 to 13 and like parts are assigned the same reference numerals. In this case the awning is constructed and arranged to define a cut-out section 131 for receiving a security shutter housing 132 provided over an opening 133 covered by the awning 130.

The awnings according to the invention represent a substantial improvement over prior art illuminated awnings. The invention provides an awning in which the illumination of the sheet material is substantially even. This is achieved by supporting the flexible sheet on a translucent support. In addition, the illumination of the sheet material is achieved by spacing lights, and in particular strip lights, stepped back away from the sheet material. There are no parts of the framework lying between the illuminating lights and the flexible sheet which are not transparent. Thus, no shadows are cast on the sheet and the illumination is substantially even.

The invention is not limited to the embodiments hereinbefore described which may be varied in both construction and detail.

We claim:

1. An awning having opposite side portions and a main continuous convex portion defining a top and front surface of the awning with a back top edge and a front bottom edge, said edges being spaced apart in each of two mutually perpendicular planes wherein the awning comprises, a framework, a rigid support mounted to the framework, the rigid support including a continuous convex sheet of translucent material defining at least a part of said convex portion of the awning, a translucent flexible sheet positioned over said continuous convex sheet, and mounting means within the awning for illumination means adapted to illuminate the flexible sheet through the rigid support.

2. An awning as claimed in claim 1 wherein said continuous convex sheet of translucent material defines the entire convex portion of the awning and the support further includes rigid translucent side panels defining the side portions of the awning.

3. An awning as claimed in claim 2 wherein the mounting means for the illumination means are located in a space between parts of the framework and the convex sheet of translucent material.

4. An awning as claimed in claim 1 wherein the framework comprises a lower support member and an upper support member to which the rigid support is mounted.

5. An awning as claimed in claim 1 wherein the mounting means for the illumination means is mounted to the framework.

6. An awning as claimed in claim 5 wherein the mounting means for the illumination means comprises at least two spaced-apart illumination means support members which are stepped back from the rigid support.

7. An awning as claimed in claim 6 wherein each of the illumination means support members extends from an upper support member to a lower support member of the framework.

8. An awning as claimed in claim 5 wherein the upper support member is a rearward support member and the lower support member is a forward support member.

9. An awning as claimed in claim 5 wherein the mounting means for the illumination means is mounting clips provided on the illumination means support members.

10. An awning as claimed in claim 1 wherein the illumination means comprises strip lights.

11. An awning as claimed in claim 1 including a bottom panel.

12. An awning as claimed in claim 1 wherein the flexible sheet is provided with sheet tensioning means.

13. An awning as claimed in claim 1 wherein the flexible sheet has advertising material marked thereon.

* * * * *